US009555518B2

(12) United States Patent
Huang et al.

(10) Patent No.: US 9,555,518 B2
(45) Date of Patent: Jan. 31, 2017

(54) POLISHING PAD WITH MULTI-MODAL DISTRIBUTION OF PORE DIAMETERS

(71) Applicant: NexPlanar Corporation, Hillsboro, OR (US)

(72) Inventors: Ping Huang, Eden Prairie, MN (US); Diane Scott, Portland, OR (US); James P. LaCasse, Portland, OR (US); William C. Allison, Beaverton, OR (US)

(73) Assignee: NexPlanar Corporation, Hillsboro, OR (US)

( * ) Notice: Subject to any disclaimer, the term of this patent is extended or adjusted under 35 U.S.C. 154(b) by 409 days.

(21) Appl. No.: 14/183,894

(22) Filed: Feb. 19, 2014

(65) Prior Publication Data

US 2014/0167305 A1 Jun. 19, 2014

Related U.S. Application Data

(62) Division of application No. 12/979,123, filed on Dec. 27, 2010, now Pat. No. 8,702,479.

(60) Provisional application No. 61/393,746, filed on Oct. 15, 2010.

(51) Int. Cl.
*B24B 37/24* (2012.01)
*B24B 37/26* (2012.01)

(52) U.S. Cl.
CPC ..... *B24B 37/24* (2013.01); *B24B 37/26* (2013.01)

(58) Field of Classification Search
CPC ..... B24D 3/32; B24D 3/26; C09G 1/00; B24B 37/24; B24B 37/26
See application file for complete search history.

(56) References Cited

U.S. PATENT DOCUMENTS

| | | | | |
|---|---|---|---|---|
| 6,126,532 | A | 10/2000 | Sevilla et al. | |
| 6,231,942 | B1 | 5/2001 | Blizard et al. | |
| 6,239,188 | B1 | 5/2001 | Kihara et al. | |
| 6,913,517 | B2 | 7/2005 | Prasad | |
| 7,435,364 | B2 | 10/2008 | James et al. | |
| 7,976,901 | B2 | 7/2011 | Kume et al. | |
| 8,075,372 | B2 | 12/2011 | Prasad | |
| 2003/0008244 | A1 | 1/2003 | Khanarian et al. | |
| 2003/0109209 | A1* | 6/2003 | Hishiki | B24B 37/24 451/527 |
| 2003/0220061 | A1 | 11/2003 | Prasad | |
| 2004/0072522 | A1 | 4/2004 | Petroski et al. | |
| 2005/0171224 | A1 | 8/2005 | Kulp | |
| 2005/0215177 | A1 | 9/2005 | Prasad | |

(Continued)

FOREIGN PATENT DOCUMENTS

| | | |
|---|---|---|
| CN | 1915598 | 2/2007 |
| CN | 101219531 | 7/2008 |

(Continued)

OTHER PUBLICATIONS

Second Chinese Office Action for Application No. 201180049789.4, dated Jul. 24, 2015, 5 pages.

(Continued)

*Primary Examiner* — Stella Yi
(74) *Attorney, Agent, or Firm* — Thomas Omholt; Erika Wilson; Justin K. Brask

(57) ABSTRACT

Polishing pads with multi-modal distributions of pore diameters are described. Methods of fabricating polishing pads with multi-modal distributions of pore diameters are also described.

13 Claims, 13 Drawing Sheets

(56) References Cited

U.S. PATENT DOCUMENTS

| | | | |
|---|---|---|---|
| 2006/0276109 | A1 | 12/2006 | Roy et al. |
| 2007/0042682 | A1 | 2/2007 | Saikin |
| 2007/0042693 | A1 | 2/2007 | Saikin |
| 2009/0053976 | A1 | 2/2009 | Roy et al. |
| 2009/0137120 | A1 | 5/2009 | Huang et al. |
| 2010/0029182 | A1 | 2/2010 | Fukuda et al. |
| 2012/0094586 | A1 | 4/2012 | Huang et al. |
| 2012/0279138 | A1 | 11/2012 | Fukuda et al. |
| 2014/0033615 | A1 | 2/2014 | Itoyama et al. |
| 2014/0106652 | A1 | 4/2014 | Itoyama et al. |

FOREIGN PATENT DOCUMENTS

| | | |
|---|---|---|
| CN | 101511537 | 8/2009 |
| JP | 11-322877 | 11/1999 |
| JP | 2000-344902 | 12/2000 |
| JP | 2008-168416 | 7/2008 |
| JP | 2008-238399 | 10/2008 |
| JP | 2009-514027 | 4/2009 |
| JP | 2010228076 | 10/2010 |
| KR | 10-2010-0106841 | 10/2010 |
| TW | I280266 | 5/2007 |
| TW | 201018545 | 5/2010 |
| WO | WO-03/099518 | 12/2003 |
| WO | WO-2009/126171 | 10/2009 |
| WO | WO-2013058183 | 4/2013 |

OTHER PUBLICATIONS

Third Chinese Office Action for Application No. 201180049789.4, dated Jan. 27, 2016, 14 pages.
First European Office Action for Application No. 11773633.0, dated Sep. 22, 2015, 4 pages.
Second European Office Action for Application No. 11773633.0, dated May 30, 2016, 4 pages.
First Israeli Office Action for Application 225390, dated Dec. 31, 2015, 2 pages.
First Japanese Office Action for Application No. 2015-88319, dated Jun. 8, 2016, 1 page.
First Korean Office Action for Application No. 10-2015-7020203, dated Oct. 20, 2015, 6 pages.
Search Report from Taiwan Patent Application No. 100137387 dated May 6, 2015, 2 pgs.
First Office Action from Chinese Patent Application No. 201180049789.4 mailed Nov. 15, 2014, 6 pgs.
Notice of Final Rejection from Japanese Patent Application No. 2013-533944 mailed Dec. 26, 2014, 5 pgs.
Decision of Final Rejection from Korean Patent Application No. 10-2013-7010017 mailed Sep. 29, 2014, 5 pgs.
Notification of Grounds for Refusal from Korean Patent Application No. 10-2014-7024352 mailed Sep. 22, 2014, 3 pgs.
Office Action from Taiwan Patent Application No. 100137387 dated Nov. 12, 2014, 3 pgs.
Notice of Reasons for Rejection from Japanese Patent Application No. 2013-533944 mailed Mar. 27, 2014, 4 pgs.
Notification of Grounds for Refusal from Korean Patent Application No. 10-2013-7010017 mailed Jan. 16, 2014, 7 pgs.
Decision of Final Rejection from Korean Patent Application No. 10-2013-7010017 mailed Jul. 31, 2014, 5 pgs.
International Search Report and Written Opinion from PCT/US2011/055796 mailed Feb. 20, 2012, 8 pgs.
International Preliminary Report on Patentability from PCT/US US2011/055796 mailed Apr. 25, 2013, 5 pgs.
Office Action from Taiwan Patent Application No. 100137387 mailed Dec. 26, 2013, 4 pgs.
Non-Final Office Action from U.S. Appl. No. 12/979,123 mailed Jun. 14, 2013, 10 pgs.
Notification of Grounds for Refusal for Korean Patent Application No. 10-2014-7024352 mailed Mar. 26, 2015, 6 pgs.

* cited by examiner

POLISHING PAD WITH MULTI-MODAL DISTRIBUTION OF PORE DIAMETERS

CROSS-REFERENCE TO RELATED APPLICATIONS

This application is a divisional of U.S. patent application Ser. No. 12/979,123, filed Dec. 27, 2010, which claims the benefit of U.S. Provisional Application No. 61/393,746, filed Oct. 15, 2010, the entire contents of which are hereby incorporated by reference herein.

TECHNICAL FIELD

Embodiments of the present invention are in the field of chemical mechanical polishing (CMP) and, in particular, polishing pads with multi-modal distributions of pore diameters.

BACKGROUND

Chemical-mechanical planarization or chemical-mechanical polishing, commonly abbreviated CMP, is a technique used in semiconductor fabrication for planarizing a semiconductor wafer or other substrate.

The process uses an abrasive and corrosive chemical slurry (commonly a colloid) in conjunction with a polishing pad and retaining ring, typically of a greater diameter than the wafer. The polishing pad and wafer are pressed together by a dynamic polishing head and held in place by a plastic retaining ring. The dynamic polishing head is rotated during polishing. This approach aids in removal of material and tends to even out any irregular topography, making the wafer flat or planar. This may be necessary in order to set up the wafer for the formation of additional circuit elements. For example, this might be necessary in order to bring the entire surface within the depth of field of a photolithography system, or to selectively remove material based on its position. Typical depth-of-field requirements are down to Angstrom levels for the latest sub-50 nanometer technology nodes.

The process of material removal is not simply that of abrasive scraping, like sandpaper on wood. The chemicals in the slurry also react with and/or weaken the material to be removed. The abrasive accelerates this weakening process and the polishing pad helps to wipe the reacted materials from the surface. In addition to advances in slurry technology, the polishing pad plays a significant role in increasingly complex CMP operations.

However, additional improvements are needed in the evolution of CMP pad technology.

SUMMARY

Embodiments of the present invention include polishing pads with multi-modal distributions of pore diameters.

In an embodiment, a polishing pad for polishing a semiconductor substrate includes a homogeneous polishing body. The homogeneous polishing body includes a thermoset polyurethane material and a plurality of closed cell pores disposed in the thermoset polyurethane material. The plurality of closed cell pore has a multi-modal distribution of diameters.

In another embodiment, a method of fabricating a polishing pad for polishing a semiconductor substrate includes mixing a pre-polymer and a curative to form a mixture in a formation mold. The mixture is cured to provide a molded homogeneous polishing body including a thermoset polyurethane material and a plurality of closed cell pores disposed in the thermoset polyurethane material. The plurality of closed cell pores has a multi-modal distribution of diameters.

DETAILED DESCRIPTION

Figure 1A:
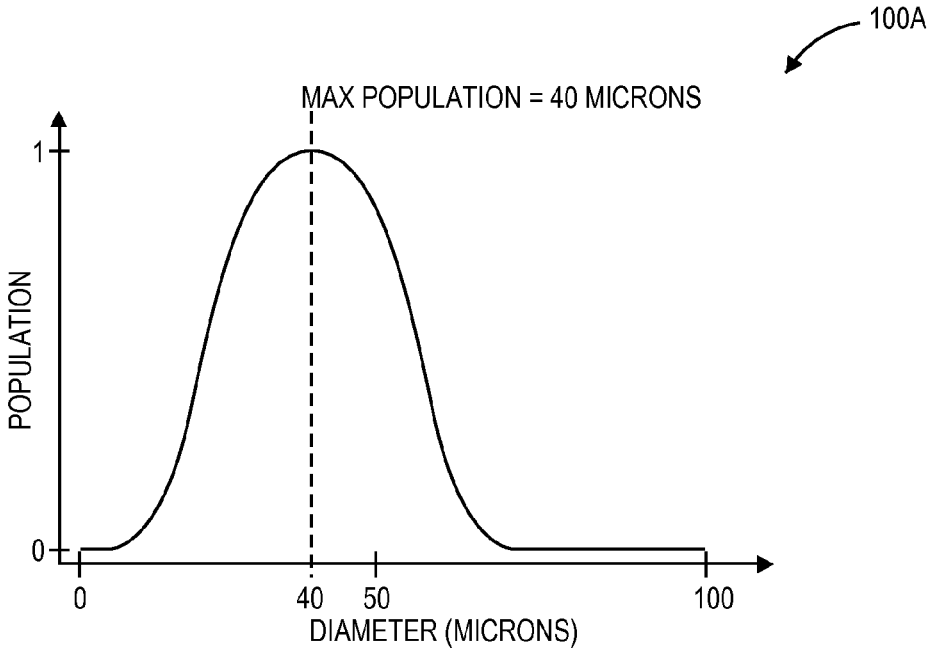
FIG. 1A illustrates a plot of population as a function of pore diameter for a broad mono-modal distribution of pore diameters in a conventional polishing pad.

Polishing pads with multi-modal distributions of pore diameters are described herein. In the following description, numerous specific details are set forth, such as specific polishing pad compositions and designs, in order to provide a thorough understanding of embodiments of the present invention. It will be apparent to one skilled in the art that embodiments of the present invention may be practiced without these specific details. In other instances, well-known processing techniques, such as details concerning the combination of a slurry with a polishing pad to perform CMP of a semiconductor substrate, are not described in detail in order to not unnecessarily obscure embodiments of the present invention. Furthermore, it is to be understood that the various embodiments shown in the figures are illustrative representations and are not necessarily drawn to scale.

Embodiments of the present invention relate to porosity in polishing pads, and in particular to the size and number density of the pores. Pores in polishing pads may be provided to increase the surface area of a polishing pad to, e.g., increase the capability of slurry retention by the polishing pad. Conventionally, for closed cell polishing pads, the pores are generally described as having one size, for example 40 micron diameter pores. In fact, the pores are a distribution of pore diameters that have a mean or median pore size approximating 40 microns, and the distribution approximates a classic mono-modal bell curve distribution, as described below in association with FIGS. 1A and 1B.

By contrast, embodiments of the present invention include polishing pads with a bimodal, trimodal, etc. distribution in pore size. Examples include, but are not limited to, combinations of 20 micron and 40 micron pores, 20 micron and 80 micron pores, 40 micron and 80 micron pores, and the trimodal 20, 40 and 80 micron pores. Advantages of including this type of pore size distribution in a polishing pad may include one or more of: (1) an ability to increase the total number of pores per unit area, due to more efficient packing of a range of pore sizes, (2) an ability to increase the total pore area, (3) improved slurry distribution across the polishing pad surface as a result of a greater number density of pores at the surface, (4) increased volume of slurry available for interaction with the wafer as a result of larger pores being open at the surface in combination with smaller pore sizes provided for uniformity, or (5) an ability to optimize bulk mechanical properties. Particularly in the case of a highly chemically-driven CMP process and in the case of large (e.g., 300 mm or 450 mm diameter) wafers, it may be important that the slurry is between the wafer and a polishing pad at all times throughout the polishing process. This avoids slurry starvation which may otherwise limit the polish performance. To address this, embodiments of the present invention may allow for greater volumes of slurry to be available between the wafer and a polishing pad.

Figure 1B:
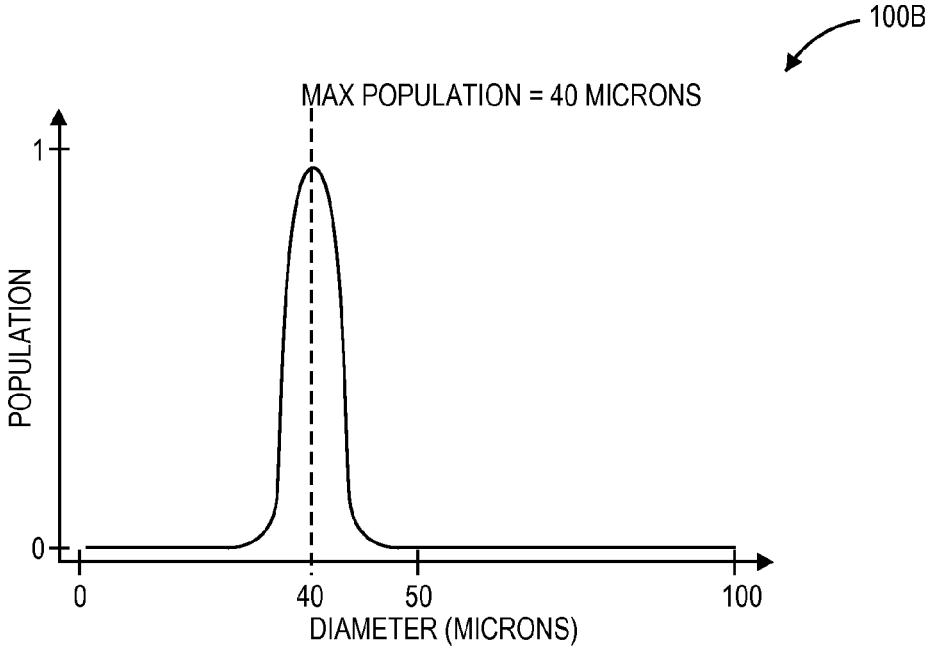
FIG. 1B illustrates a plot of population as a function of pore diameter for a narrow mono-modal distribution of pore diameters in a conventional polishing pad.

As described above, a distribution of pore diameters in a polishing pad conventionally has a bell curve or mono-modal distribution. For example, FIG. 1A illustrates a plot 100A of population as a function of pore diameter for a mono-modal distribution of pore diameters in a conventional polishing pad. Referring to FIG. 1A, the mono-modal distribution may be relatively broad. As another example, FIG. 1B illustrates a plot 100B of population as a function of pore diameter for a narrow mono-modal distribution of pore diameters in a conventional polishing pad. In either the narrow distribution or the broad distribution, only one maximum diameter population, such as a maximum population at 40 microns, is provided in the polishing pad.

In an aspect of the present invention, a polishing pad may instead be fabricated with a bimodal distribution of pore diameters. As an example, FIG. 2A illustrates a cross-sectional view of a polishing pad having an approximately 1:1 bimodal distribution of closed-cell pores, in accordance with an embodiment of the present invention.

Figure 2A:
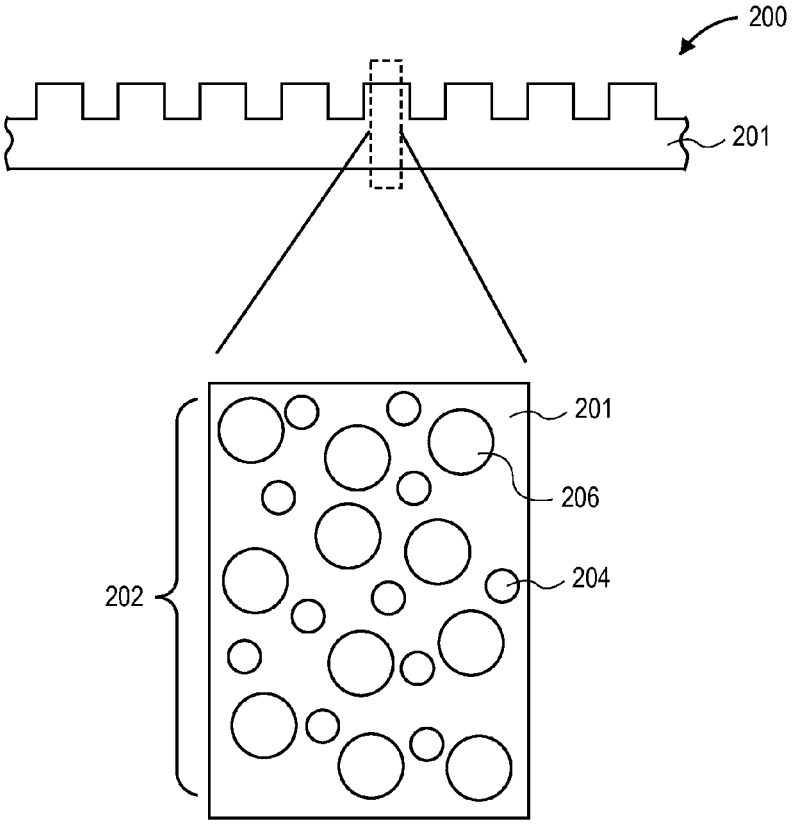
FIG. 2A illustrates a cross-sectional view of a polishing pad having an approximately 1:1 bimodal distribution of closed-cell pores, in accordance with an embodiment of the present invention.

Referring to FIG. 2A, a polishing pad 200 for polishing a semiconductor substrate includes a homogeneous polishing body 201. The homogeneous polishing body 201 is composed of a thermoset polyurethane material with a plurality of closed cell pores 202 disposed in the homogeneous polishing body 201. The plurality of closed cell pores 202 has a multi-modal distribution of diameters. In an embodiment, the multi-modal distribution of diameters is a bimodal distribution of diameters including a small diameter mode 204 and a large diameter mode 206, as depicted in FIG. 2A.

In an embodiment, the polishing pad 200 for polishing a semiconductor substrate is suitable for polishing a substrate used in the semiconductor manufacturing industry, such as a silicon substrate having device or other layers disposed thereon. However, the polishing pad 200 for polishing a semiconductor substrate may be used in chemical mechanical polishing processes involving other related substrates, such as, but not limited to, substrates for MEMS devices or reticles. Thus, reference to "a polishing pad for polishing a semiconductor substrate," as used herein, is intended to encompass all such possibilities.

In an embodiment, the plurality of closed cell pores 202 includes pores that are discrete from one another, as depicted in FIG. 2A. This is in contrast to open cell pores which may be connected to one another through tunnels, such as the case for the pores in a common sponge. In one embodiment, each of the closed cell pores includes a physical shell, such as a shell of a porogen as described in more detail below. In another embodiment, however, each of the closed cell pores does not include a physical shell. In an embodiment, the plurality of closed cell pores 202, and hence the multi-modal distribution of diameters, is distributed essentially evenly and uniformly throughout the thermoset polyurethane material of homogeneous polishing body 201, as depicted in FIG. 2A.

As mentioned above, the homogeneous polishing body 201 may be composed of a thermoset, closed cell polyurethane material. In an embodiment, the term "homogeneous" is used to indicate that the composition of a thermoset, closed cell polyurethane material is consistent throughout the entire composition of the polishing body. For example, in an embodiment, the term "homogeneous" excludes polishing pads composed of, e.g., impregnated felt or a composition (composite) of multiple layers of differing material. In an embodiment, the term "thermoset" is used to indicate a polymer material that irreversibly cures, e.g., the precursor to the material changes irreversibly into an infusible, insoluble polymer network by curing. For example, in an embodiment, the term "thermoset" excludes polishing pads composed of, e.g., "thermoplast" materials or "thermoplastics"—those materials composed of a polymer that turns to a liquid when heated and freezes to a very glassy state when cooled sufficiently. It is noted that polishing pads made from thermoset materials are typically fabricated from lower molecular weight precursors reacting to form a polymer in a chemical reaction, while pads made from thermoplastic materials are typically fabricated by heating a pre-existing polymer to cause a phase change so that a polishing pad is formed in a physical process. In an embodiment, the homogeneous polishing body 201 is a compression molded homogeneous polishing body. The term "molded" is used to indicate that a homogeneous polishing body is formed in a formation mold, as described in more detail below. In an embodiment, the homogeneous polishing body 201, upon conditioning and/or polishing, has a polishing surface roughness approximately in the range of 1-5 microns root mean square. In one embodiment, the homogeneous polishing body 201, upon conditioning and/or polishing, has a polishing surface roughness of approximately 2.35 microns root mean square. In an embodiment, the homogeneous polishing body 201 has a storage modulus at 25 degrees Celsius approximately in the range of 30-120 megaPascals (MPa). In another embodiment, the homogeneous polishing body 201 has a storage modulus at 25 degrees Celsius approximately less than 30 megaPascals (MPa).

In an embodiment, as mentioned briefly above, the plurality of closed cell pores 202 is composed of porogens. In one embodiment, the term "porogen" is used to indicate micro- or nano-scale spherical particles with "hollow" centers. The hollow centers are not filled with solid material, but may rather include a gaseous or liquid core. In one embodiment, the plurality of closed cell pores 202 is composed of pre-expanded and gas-filled EXPANCEL™ distributed throughout (e.g., as an additional component in) the homogeneous polishing body 201. In a specific embodiment, the EXPANCEL™ is filled with pentane. In an embodiment, each of the plurality of closed cell pores 202 has a diameter approximately in the range of 10-100 microns. It is to be understood that use of the term "spherical" need not be limited to perfectly spherical bodies. For example, other generally rounded bodies may be considered, such as but not limited to, almond-shaped, egg-shaped, scalene, elliptical, football-shaped, or oblong bodies may be considered for pore shape or porogen shape. In such cases, the noted diameter is the largest diameter of such a body.

In an embodiment, the homogeneous polishing body 201 is opaque. In one embodiment, the term "opaque" is used to indicate a material that allows approximately 10% or less visible light to pass. In one embodiment, the homogeneous polishing body 201 is opaque in most part, or due entirely to, the inclusion of an opacifying lubricant throughout (e.g., as an additional component in) the homogeneous thermoset, closed cell polyurethane material of homogeneous polishing body 201. In a specific embodiment, the opacifying lubricant is a material such as, but not limited to: boron nitride, cerium fluoride, graphite, graphite fluoride, molybdenum sulfide, niobium sulfide, talc, tantalum sulfide, tungsten disulfide, or Teflon.

The sizing of the homogeneous polishing body 201 may be varied according to application. Nonetheless, certain parameters may be used to make polishing pads including such a homogeneous polishing body compatible with conventional processing equipment or even with conventional chemical mechanical processing operations. For example, in accordance with an embodiment of the present invention, the homogeneous polishing body 201 has a thickness approximately in the range of 0.075 inches to 0.130 inches, e.g., approximately in the range of 1.9-3.3 millimeters. In one embodiment, the homogeneous polishing body 201 has a diameter approximately in the range of 20 inches to 30.3 inches, e.g., approximately in the range of 50-77 centimeters, and possibly approximately in the range of 10 inches to 42 inches, e.g., approximately in the range of 25-107 centimeters. In one embodiment, the homogeneous polishing body 201 has a pore (202) density approximately in the range of 6%-36% total void volume, and possibly approximately in the range of 18%-30% total void volume. In one embodiment, the homogeneous polishing body 201 has a porosity of the closed cell type, as described above, due to inclusion of the plurality of pores 202. In one embodiment, the homogeneous polishing body 201 has a compressibility of approximately 2.5%. In one embodiment, the homogeneous polishing body 201 has a density approximately in the range of 0.70-1.05 grams per cubic centimeter.

Figure 2B:
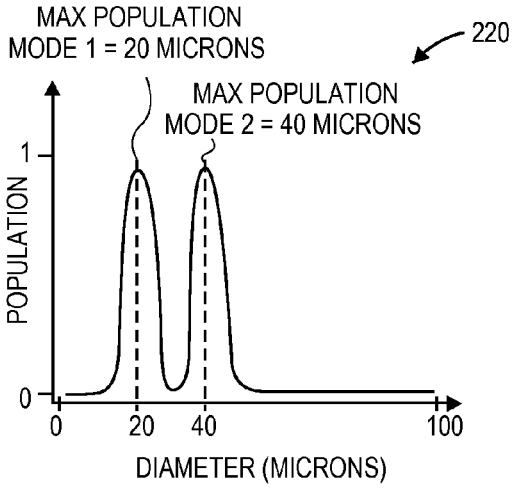
FIG. 2B illustrates a plot of population as a function of pore diameter for a narrow distribution of pore diameters in the polishing pad of FIG. 2A, in accordance with an embodiment of the present invention.
Figure 2C:
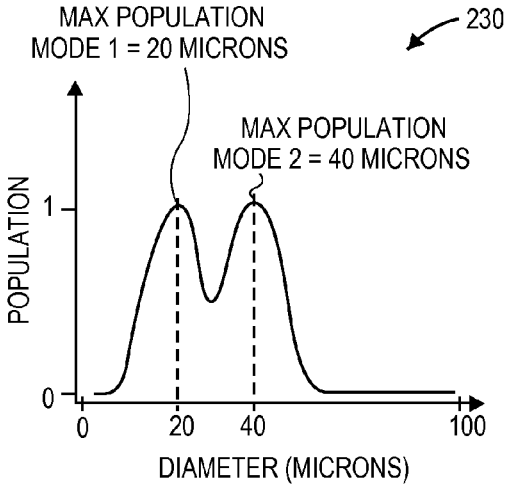
FIG. 2C illustrates a plot of population as a function of pore diameter for a broad distribution of pore diameters in the polishing pad of FIG. 2A, in accordance with an embodiment of the present invention.

In an embodiment, the bimodal distribution of pore diameters of the plurality of closed cell pores 202 may be approximately 1:1, as depicted in FIG. 2A. To better illustrate the concept, FIG. 2B illustrates a plot 220 of population as a function of pore diameter for a narrow distribution of pore diameters in the polishing pad of FIG. 2A, in accordance with an embodiment of the present invention. FIG. 2C illustrates a plot 230 of population as a function of pore diameter for a broad distribution of pore diameters in the polishing pad of FIG. 2A, in accordance with an embodiment of the present invention.

Referring to FIGS. 2A-2C, the diameter value for the maximum population of the large diameter mode 206 is approximately twice the diameter value of the maximum population of the small diameter mode 204. For example, in one embodiment, the diameter value for the maximum population of the large diameter mode 206 is approximately 40 microns and the diameter value of the maximum population of the small diameter mode 204 is approximately 20 microns, as depicted in FIGS. 2B and 2C. As another example, the diameter value for the maximum population of the large diameter mode 206 is approximately 80 microns and the diameter value of the maximum population of the small diameter mode 204 is approximately 40 microns.

Referring to plot 220 of FIG. 2B, in one embodiment, the distributions of pore diameters are narrow. In a specific embodiment, the population of the large diameter mode 206 has essentially no overlap with the population of the small diameter mode 204. However, referring to plot 230 of FIG. 2C, in another embodiment, the distributions of pore diameters are broad. In a specific embodiment, the population of the large diameter mode 206 overlaps with the population of the small diameter mode 204.

Figure 3A:
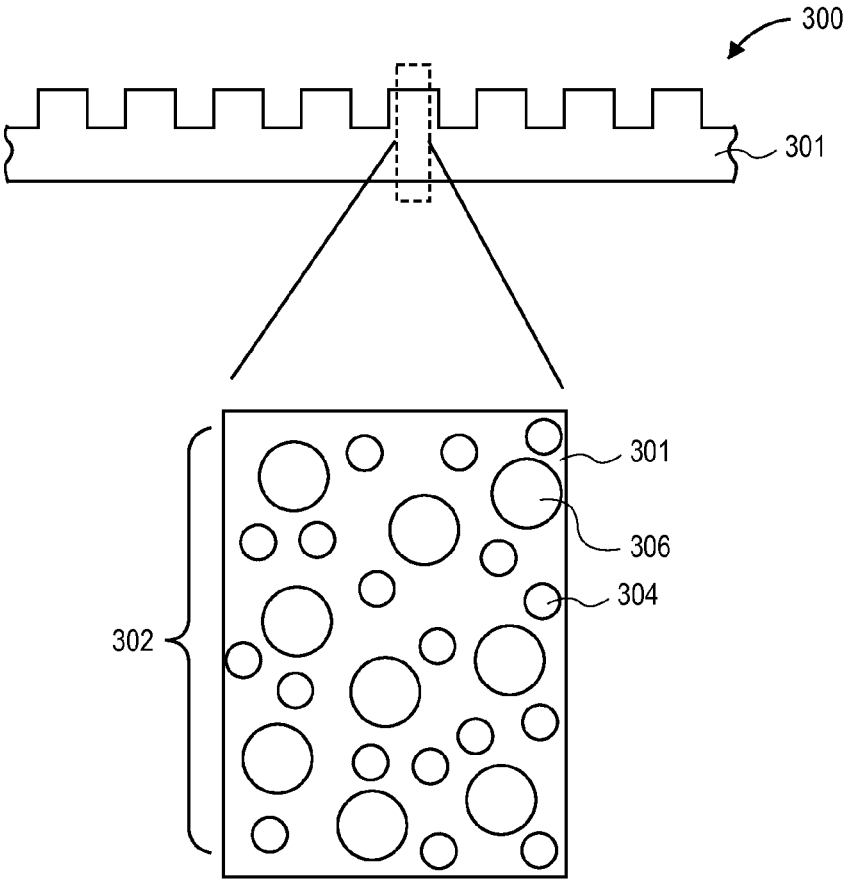
FIG. 3A illustrates a cross-sectional view of a polishing pad having an approximately 2:1 bimodal distribution of closed-cell pores, in accordance with an embodiment of the present invention.
Figure 3B:
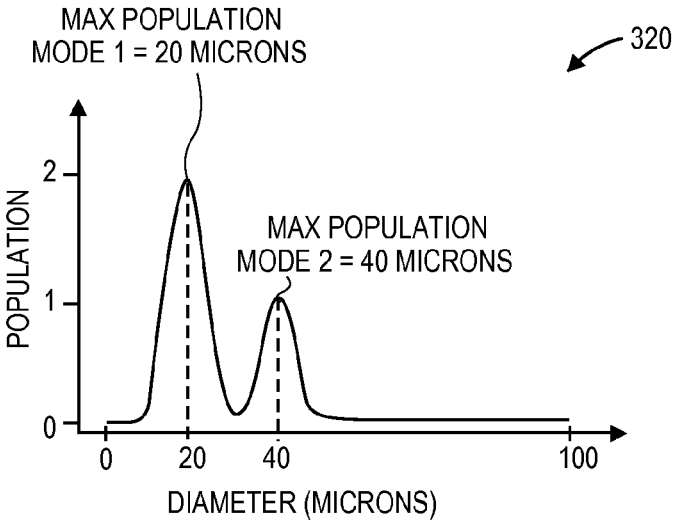
FIG. 3B illustrates a plot of population as a function of pore diameter for a distribution of pore diameters in the polishing pad of FIG. 3A, in accordance with an embodiment of the present invention.

In another aspect of the present invention, a bimodal distribution of pore diameters need not be 1:1, as is described above in association with FIGS. 2A-2C. That is, in an embodiment, the total population of a large diameter mode is not equal to the total population of a small diameter mode. As an example, FIG. 3A illustrates a cross-sectional view of a polishing pad having an approximately 2:1 bimodal distribution of closed-cell pores, in accordance with an embodiment of the present invention. FIG. 3B illustrates a plot 320 of population as a function of pore diameter for a distribution of pore diameters in the polishing pad of FIG. 3A, in accordance with an embodiment of the present invention.

Referring to FIG. 3A, a polishing pad 300 for polishing a semiconductor substrate includes a homogeneous polishing body 301. The homogeneous polishing body 301 is composed of a thermoset polyurethane material with a plurality of closed cell pores 302 disposed in the homogeneous polishing body 301. The plurality of closed cell pores 302 has a multi-modal distribution of diameters. In an embodiment, the multi-modal distribution of diameters is a bimodal distribution of diameters including a small diameter mode 304 and a large diameter mode 306, as depicted in FIG. 3A.

Referring to FIGS. 3A and 3B, the total population of the small diameter mode 304 is approximately twice the total population of the large diameter mode 306. That is, there is approximately two times the number of small closed cell pores as compared to large closed cell pores. In one embodiment, the diameter value for the maximum population of the large diameter mode 306 is approximately twice the diameter value of the maximum population of the small diameter mode 304. For example, in one embodiment, the diameter value for the maximum population of the large diameter mode is approximately 40 microns and the diameter value of the maximum population of the small diameter mode is approximately 20 microns, as depicted in FIG. 3B. It is to be understood that any ratio of total population of the small diameter mode 304 to the total population of the large diameter mode 306 may be selected based on the desired characteristics of polishing pad 300.

Figure 4A:
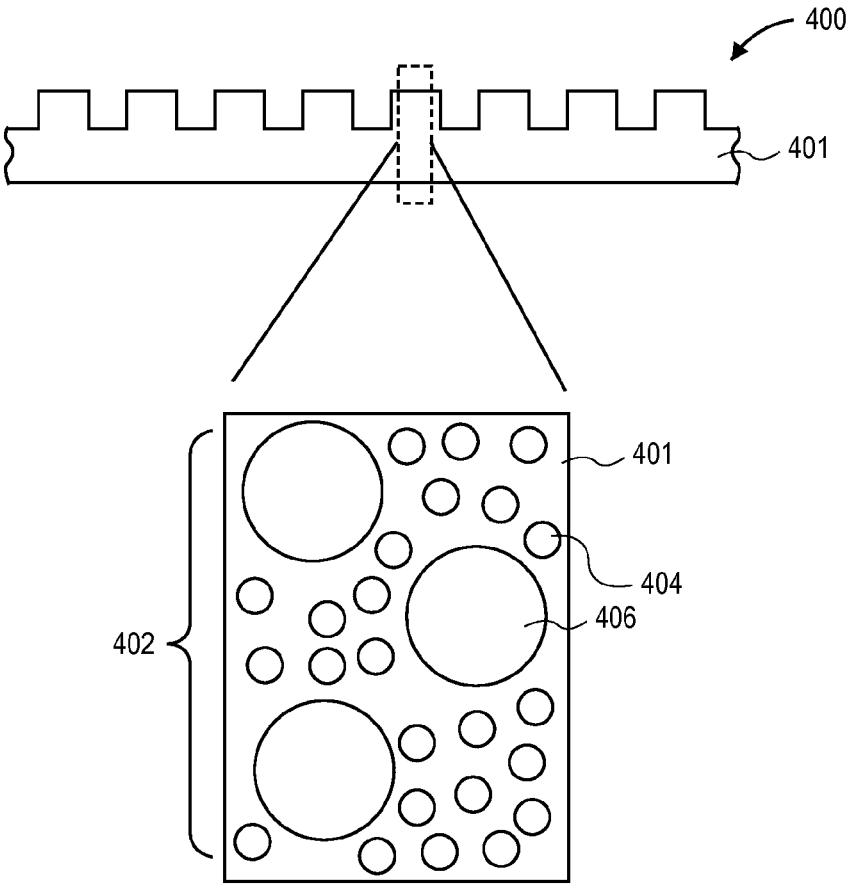
FIG. 4A illustrates a cross-sectional view of a polishing pad having a bimodal distribution of closed-cell pores with a diameter value for the maximum population of a large diameter mode approximately four times the diameter value for the maximum population of a small diameter mode, in accordance with an embodiment of the present invention.
Figure 4B:
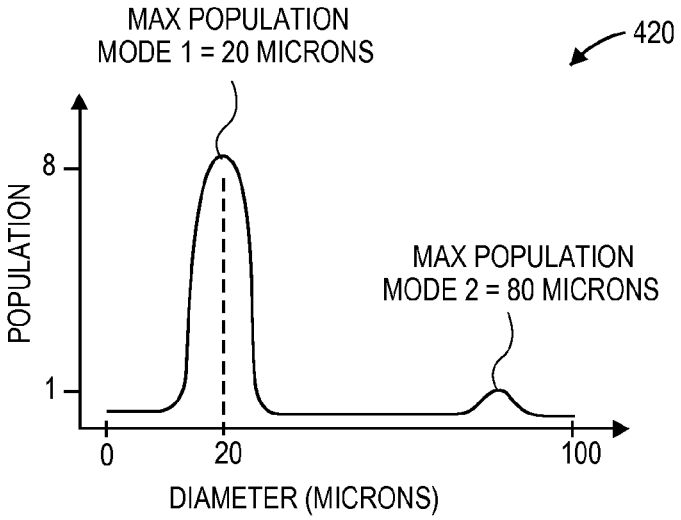
FIG. 4B illustrates a plot of population as a function of pore diameter for a distribution of pore diameters in the polishing pad of FIG. 4A, in accordance with an embodiment of the present invention.

Referring again to FIGS. 2A-2C, it is to be understood that any diameter value for the maximum population of the large diameter mode 206 and for the maximum population of the small diameter mode 204 may be selected based on the desired characteristics of polishing pad 200. Thus, the diameter value for the maximum population of a large diameter mode is not limited to being twice the maximum population of a small diameter mode, as is described above in association with FIGS. 2A-2C. As an example, FIG. 4A illustrates a cross-sectional view of a polishing pad having a bimodal distribution of closed-cell pores with a diameter value for the maximum population of a large diameter mode approximately four times the diameter value for the maximum population of a small diameter mode, in accordance with an embodiment of the present invention. FIG. 4B illustrates a plot 420 of population as a function of pore diameter for a distribution of pore diameters in the polishing pad of FIG. 4A, in accordance with an embodiment of the present invention.

Referring to FIG. 4A, a polishing pad 400 for polishing a semiconductor substrate includes a homogeneous polishing body 401. The homogeneous polishing body 401 is composed of a thermoset polyurethane material with a plurality of closed cell pores 402 disposed in the homogeneous polishing body 401. The plurality of closed cell pores 402 has a multi-modal distribution of diameters. In an embodiment, the multi-modal distribution of diameters is a bimodal distribution of diameters including a small diameter mode 404 and a large diameter mode 406, as depicted in FIG. 4A.

Referring to FIGS. 4A and 4B, the diameter value for the maximum population of the large diameter mode 406 is approximately four times the diameter value of the maximum population of the small diameter mode 404. For example, in one embodiment, the diameter value for the maximum population of the large diameter mode 406 is approximately 80 microns and the diameter value of the maximum population of the small diameter mode 404 is approximately 20 microns, as depicted in FIG. 4B. In one embodiment, the total population of the small diameter mode 404 is approximately eight times the total population of the large diameter mode 406, as is also depicted in FIG. 4B.

Figure 5A:
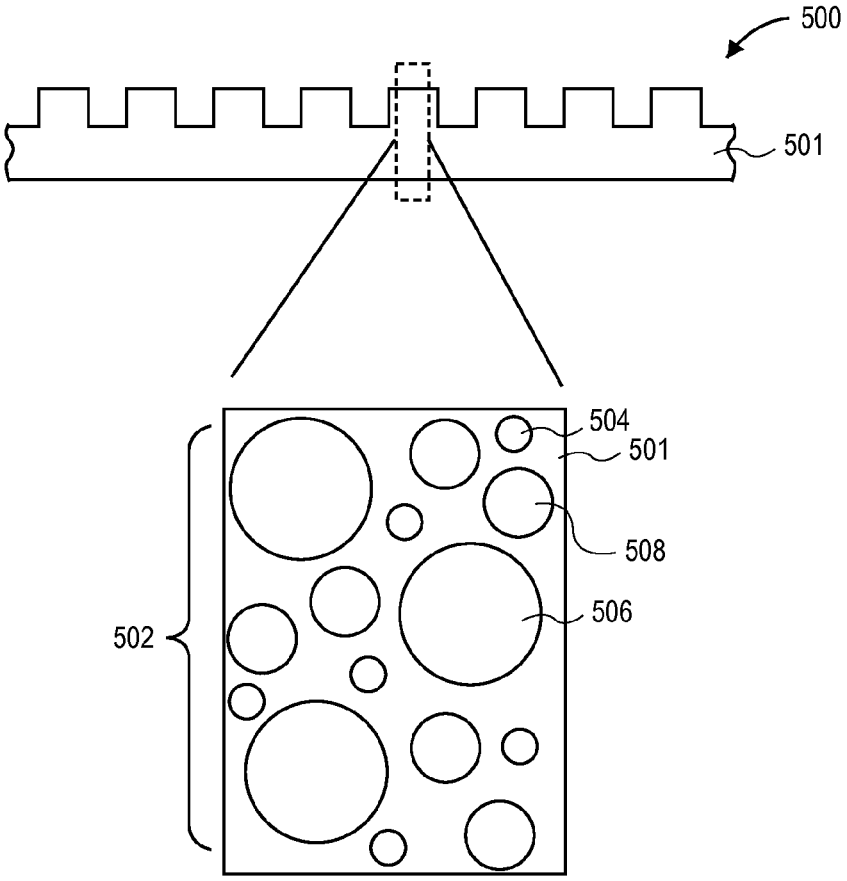
FIG. 5A illustrates a cross-sectional view of a polishing pad having a trimodal distribution of closed-cell pores, in accordance with an embodiment of the present invention.
Figure 5B:
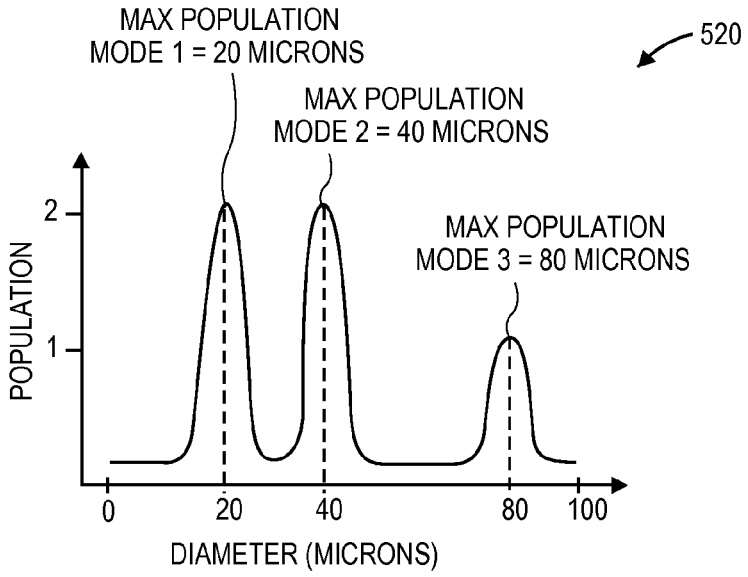
FIG. 5B illustrates a plot of population as a function of pore diameter for a distribution of pore diameters in the polishing pad of FIG. 5A, in accordance with an embodiment of the present invention.

In another aspect of the present invention, a multi-modal distribution of pore diameters need not be bimodal, as is described above in association with FIGS. 2-4. As an example, FIG. 5A illustrates a cross-sectional view of a polishing pad having a trimodal distribution of closed-cell pores, in accordance with an embodiment of the present invention. FIG. 5B illustrates a plot 520 of population as a function of pore diameter for a distribution of pore diameters in the polishing pad of FIG. 5A, in accordance with an embodiment of the present invention.

Referring to FIG. 5A, a polishing pad 500 for polishing a semiconductor substrate includes a homogeneous polishing body 501. The homogeneous polishing body 501 is composed of a thermoset polyurethane material with a plurality of closed cell pores 502 disposed in the homogeneous polishing body 501. The plurality of closed cell pores 502 has a multi-modal distribution of diameters. In an embodiment, the multi-modal distribution of diameters is a trimodal distribution of diameters including a small diameter mode 504, a large diameter mode 506, and a medium diameter mode 508, as depicted in FIG. 5A.

Referring to FIG. 5B, in an embodiment, the diameter value for the maximum population of the large diameter mode 506 is approximately 80 microns, the diameter value of the maximum population of the medium diameter mode 508 is approximately 40 microns, and the diameter value of the maximum population of the small diameter mode 504 is approximately 20 microns. In one embodiment, the total population of the small diameter mode 504 is approximately the same as the total population of the medium diameter mode 508, each of which are approximately twice the total population of the large diameter mode 506, as is also depicted in FIG. 5B. It is to be understood that any diameter value for the maximum population of the small, medium and large diameter modes, as well as any ratio of total population of the small, medium and large diameter modes may be selected based on the desired characteristics of polishing pad 500. It is also to be understood that embodiments of the present invention are not limited to bimodal and trimodal distributions, but may include any multi-modal distribution beyond the mono-modal distributions described in association with FIGS. 1A and 1B.

In an aspect of the present invention, different pore sizes may be selected to provide a desired functionality of a polishing pad. For example, FIGS. 6A-6D illustrate cross-sectional views of various stages of interaction of a slurry with a polishing pad, in accordance with an embodiment of the present invention.

Figure 6A:
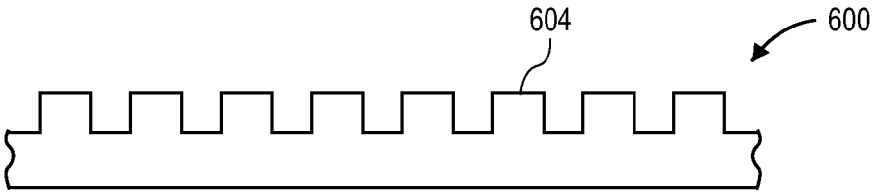
FIG. 6A illustrates a cross-sectional view of a polishing pad, in accordance with an embodiment of the present invention.

Referring to FIG. 6A, a polishing pad 600 includes a homogeneous polishing body composed of a thermoset polyurethane material with a plurality of closed cell pores disposed in the homogeneous polishing body. The plurality of closed cell pores has a multi-modal distribution of diameters.

Figure 6B:
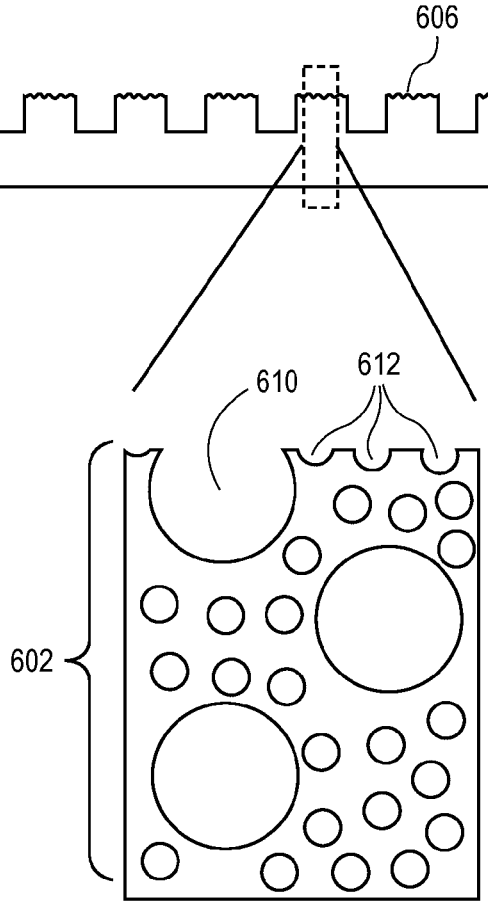
FIG. 6B illustrates a cross-sectional view of the polishing pad of FIG. 6A conditioned to expose a bimodal distribution of closed cell pores, in accordance with an embodiment of the present invention.

Referring to FIG. 6B, polishing pad 600 is conditioned to expose a bimodal distribution of closed cell pores 602. For example, in one embodiment, the top surfaces 604 of polishing pad 600 are conditioned to provide a roughened surface 606 with some of the closed cell pores 602 opened to the surface 606. In a specific embodiment, surface 604 is conditioned by using a diamond tip to remove a portion of polishing pad 600. In an embodiment, the conditioning exposes both large diameter pores 610 and small diameter pores 612 of a bimodal distribution of pore diameters, as depicted in FIG. 6B.

Figure 6C:
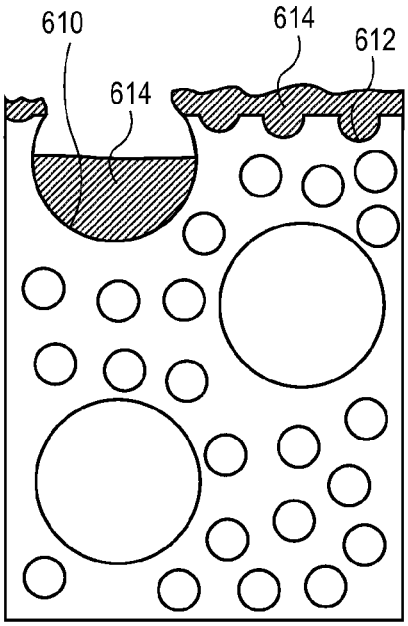
FIG. 6C illustrates a cross-sectional view of the polishing pad of FIG. 6B with a chemical mechanical polishing slurry added to a surface thereof, in accordance with an embodiment of the present invention.

Referring to FIG. 6C, a chemical mechanical polishing slurry 614 is added to the roughened or conditioned surface 606 of the polishing pad 600. In accordance with an embodiment of the present invention, the chemical mechanical polishing slurry 614 essentially, or entirely, fills the opened small diameter pores 612 and at least partially fills the opened large diameter pores 610 during a polishing process, as depicted in FIG. 6C. However, in one embodiment, throughout the polishing process, the chemical mechanical polishing slurry 614 in the opened small diameter pores 612 is consumed prior to replenishment of the slurry at the tool level.

Figure 6D:
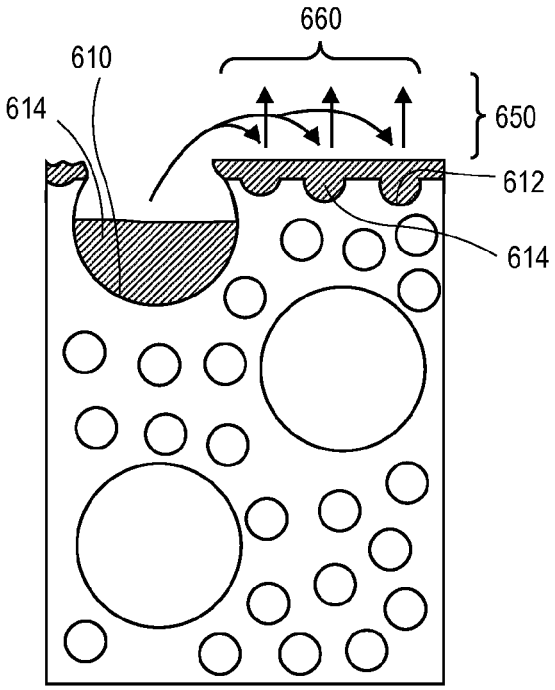
FIG. 6D illustrates a cross-sectional view of the polishing pad of FIG. 6C depicting a flow pathway for the chemical mechanical polishing slurry, in accordance with an embodiment of the present invention.

Instead, referring to FIG. 6D, the diameter of the maximum population of the pores of the large diameter mode 610 is suitable to provide reservoirs for storing polishing slurry 614 for use with the pores of the small diameter mode 612. Thus, a flow pathway 650 for the chemical mechanical polishing slurry 614 from the opened large pores 610 to the opened small diameter pores 612 is provided to locally replenish slurry 614 at the polishing surface. Furthermore, in an embodiment, the diameter of the maximum population of the closed cell pores of the small diameter mode 612 is suitable to provide a polishing surface of the polishing pad with highly uniform polishing slurry distribution 660, as depicted in FIG. 6D.

In another example of selecting different pore sizes to provide a desired functionality of a polishing pad, in an embodiment, a large pore size is included to assist with a diamond tip conditioning of a polishing pad. In one embodiment, referring again to FIG. 6B, the diameter of the maximum population of the closed cell pores of the large diameter mode 610 is suitable to provide locations for receiving a diamond tip during conditioning of the polishing pad 600. Meanwhile, the diameter of the maximum population of the closed cell pores of the small diameter mode 612 is suitable to provide a polishing surface of the polishing pad with highly uniform polishing slurry distribution, as described above in association with FIGS. 6C and 6D.

In another example of selecting different pore sizes to provide a desired functionality of a polishing pad, in an embodiment, the diameter of the maximum population of the closed cell pores of the small diameter mode provides an insufficient heat sink during a polishing process. That is, if taken on their own, the small diameter pores are too small to accommodate heat dissipation during the polishing process. However, in a bimodal embodiment of the present invention, the diameter of the maximum population of the closed cell pores of the large diameter mode is suitable to provide an excessive heat sink during a polishing process and would otherwise over heat the temperature of the slurry at the surface of a polished substrate. That is, if taken on their own, the large diameter pores will accommodate too much heat dissipation during the polishing process and would otherwise over cool the temperature of the slurry at the surface of a polished substrate. Instead, in one embodiment, the combination of the closed cell pores of the small diameter mode and the closed cell pores of the large diameter mode is suitable to provide thermal stability during the polishing process. That is the overall heat sink capability of the mixture of pore sizes provides an appropriate temperature for the slurry at the surface of a polished substrate.

In the above illustrated embodiments, the multi-modal distribution of diameters of pore sizes is distributed essentially evenly throughout the thermoset polyurethane material. In another aspect of the present invention, the multi-modal distribution of diameters of pore sizes may not be distributed essentially evenly throughout the thermoset polyurethane material. For example, FIG. 7A illustrates a cross-sectional view of a polishing pad having a graded bimodal distribution of closed-cell pores, in accordance with an embodiment of the present invention.

Figure 7A:
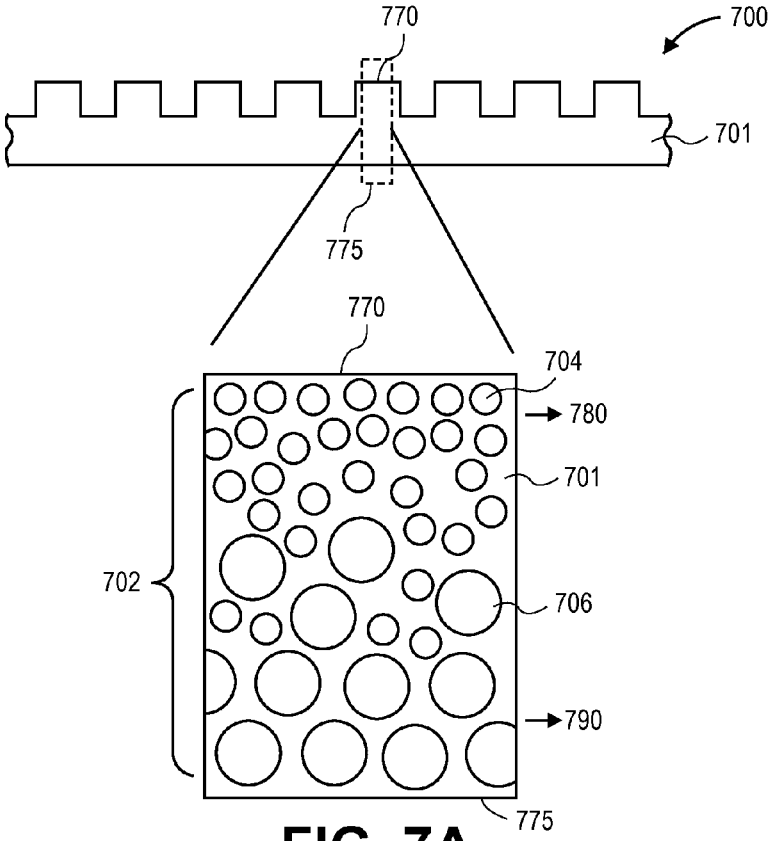
FIG. 7A illustrates a cross-sectional view of a polishing pad having a graded bimodal distribution of closed-cell pores, in accordance with an embodiment of the present invention.

Referring to FIG. 7A, a polishing pad 700 for polishing a semiconductor substrate includes a homogeneous polishing body 701. The homogeneous polishing body 701 is composed of a thermoset polyurethane material with a plurality of closed cell pores 702 disposed in the homogeneous polishing body 701. The plurality of closed cell pores 702 has a graded multi-modal distribution of diameters. In an embodiment, the graded multi-modal distribution of diameters is a graded bimodal distribution of diameters including a small diameter mode 704 and a large diameter mode 706, as depicted in FIG. 7A. The homogeneous polishing body 701 further includes a first, grooved surface 770 and a second, flat surface 775 opposite the first, grooved surface 770. The multi-modal distribution of diameters is graded throughout the thermoset polyurethane material with a gradient (780 →790) from the first, grooved surface 770 to the second, flat surface 775.

Figure 7B:
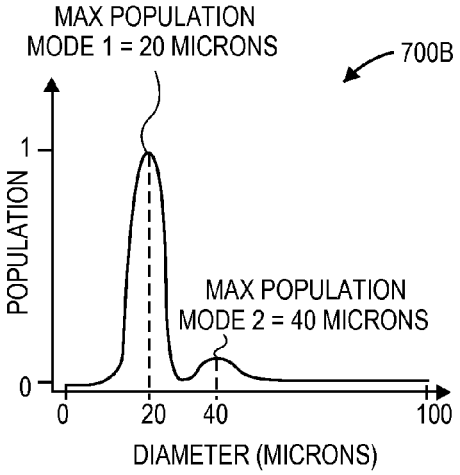
FIG. 7B illustrates a plot of population as a function of pore diameter for a first portion of the distribution of pore diameters in the polishing pad of FIG. 7A, in accordance with an embodiment of the present invention.
Figure 7C:
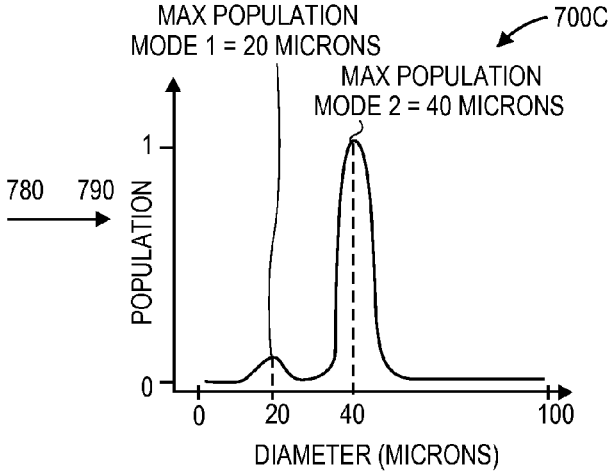
FIG. 7C illustrates a plot of population as a function of pore diameter for a second portion of the distribution of pore diameters in the polishing pad of FIG. 7A, in accordance with an embodiment of the present invention.

FIG. 7B illustrates a plot 700B of population as a function of pore diameter for a first portion, near region 780, of the distribution of pore diameters in the polishing pad 700, while FIG. 7C illustrates a plot 700C of population as a function of pore diameter for a second portion, near region 790 of the distribution of pore diameters in the polishing pad 700, in accordance with an embodiment of the present invention. Referring to FIG. 7B, the first, small diameter mode 704 is prevalent proximate to the first, grooved surface 770. Referring to FIG. 7C, the second, large diameter mode 706 is prevalent proximate to the second, flat surface 775.

The graded arrangement of pores described in association with FIGS. 7A-7C may be used to facilitate a conditioning process where a portion of pad 700 needs to be removed or roughened prior to use in a polishing process. For example, FIGS. 8A and 8B illustrate cross-sectional views of various operations in the conditioning of polishing pad having a graded bimodal distribution of closed cell pore sizes, in accordance with an embodiment of the present invention.

Figure 8A:
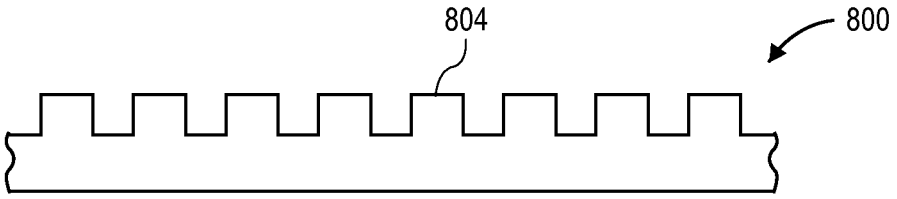
FIG. 8A illustrates a cross-sectional view of a polishing pad, in accordance with an embodiment of the present invention.

Referring to FIG. 8A, a polishing pad 800 includes a homogeneous polishing body composed of a thermoset polyurethane material with a plurality of closed cell pores disposed in the homogeneous polishing body. The plurality of closed cell pores has a graded multi-modal distribution of diameters.

Figure 8B:
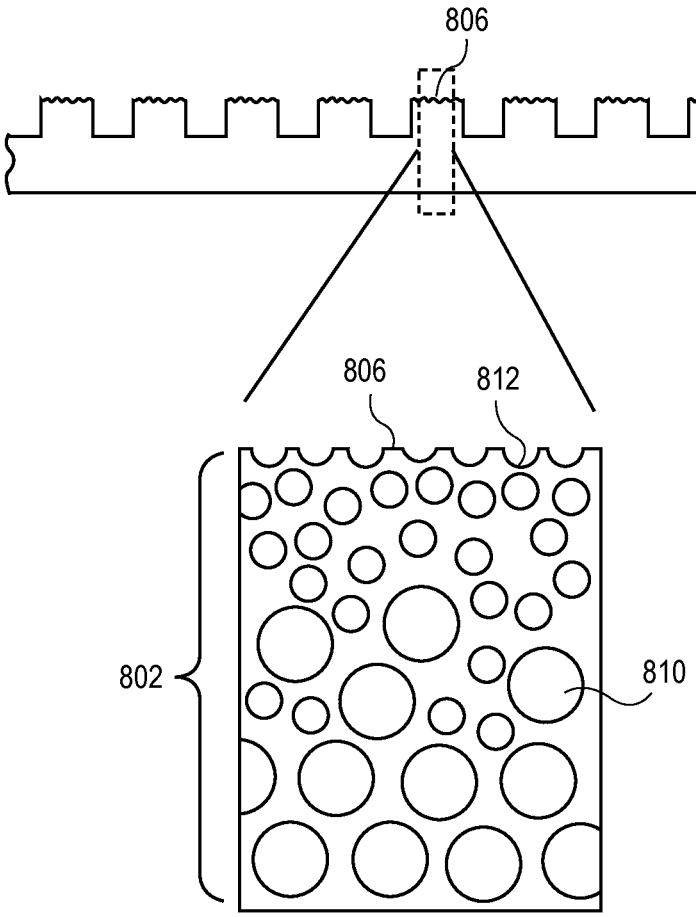
FIG. 8B illustrates cross-sectional view of an operation in the conditioning of polishing pad having a graded bimodal distribution of closed cell pore sizes, in accordance with an embodiment of the present invention.

Referring to FIG. 8B, polishing pad 800 is conditioned to expose a graded bimodal distribution of closed cell pores 802. For example, in one embodiment, the top surfaces 804 of polishing pad 800 are conditioned to provide a roughened surface 806 with some of the closed cell pores 802 opened to the surface 806. In a specific embodiment, surface 804 is conditioned by using a diamond tip to remove a portion of polishing pad 800. In an embodiment, the conditioning exposes essentially only small diameter pores 812 of a graded bimodal distribution of pore diameters, as depicted in FIG. 8B. Then, throughout the life of the polishing pad 800, large diameter pores 810 of the graded bimodal distribution of pore diameters will eventually be opened. In an embodiment, such a graded arrangement provides for an easier initial break-thorough or conditioning operation to prepare the surface of the polishing pad 800 for polishing a substrate. Following the break-thorough or conditioning operation, deeper into the polishing pad 800, larger pores provide an opportunity for holding more slurry during a polishing process. Increased slurry retention may enable the use of reduced slurry flow rates onto the polishing pad during a wafer polishing process.

In another embodiment of the present invention, a polishing pad having a multi-modal distribution of pore diameters further includes a local area transparency (LAT) region disposed in, and covalently bonded with, a homogeneous polishing body of the polishing pad. In yet another embodiment, a polishing pad having a multi-modal distribution of pore diameters further includes a detection region for use with, e.g., an eddy current detection system. Examples of suitable LAT regions and eddy current detection regions are described in U.S. patent application Ser. No. 12/895,465 filed on Sep. 30, 2010, assigned to NexPlanar Corporation.

In another aspect of the present invention, polishing pads with multi-modal distributions of pore diameters may be fabricated in a molding process. For example, FIGS. 9A-9G illustrate cross-sectional views of operations used in the fabrication of a polishing pad, in accordance with an embodiment of the present invention.

Figure 9A:
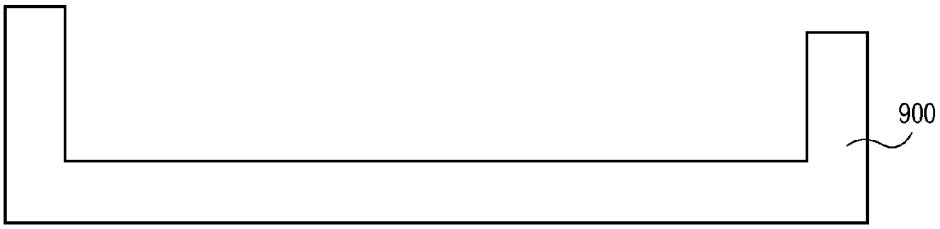
FIGS. 9A-9G illustrate cross-sectional views of operations used in the fabrication of a polishing pad, in accordance with an embodiment of the present invention.
Figure 9B:
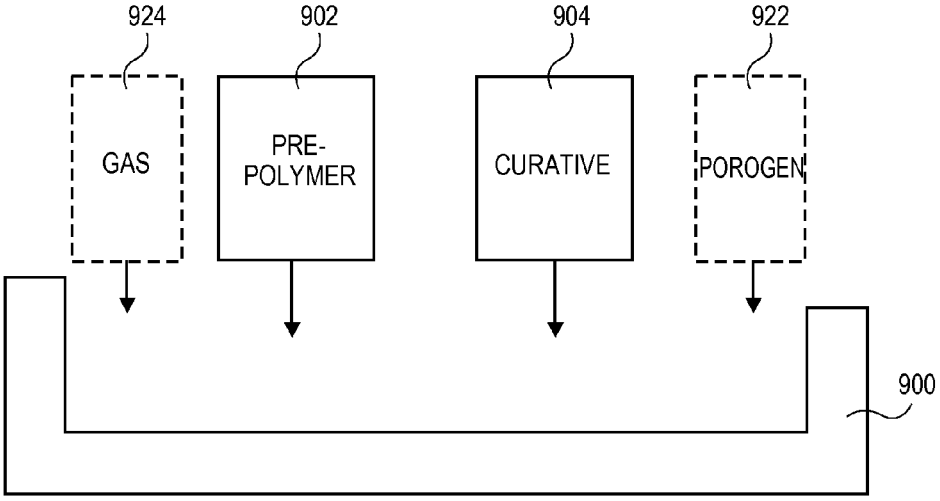
Figure 9C:
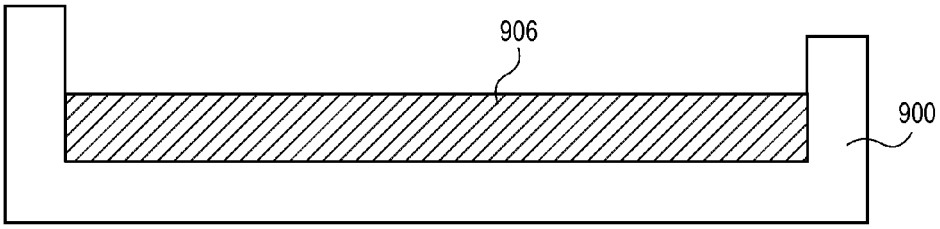

Referring to FIG. 9A, a formation mold 900 is provided. Referring to FIG. 9B, a pre-polymer 902 and a curative 904 are mixed to form a mixture 906 in the formation mold 900, as depicted in FIG. 9C. In an embodiment, mixing the pre-polymer 902 and the curative 904 includes mixing an isocyanate and an aromatic diamine compound, respectively. In one embodiment, the mixing further includes adding an opacifying lubricant to the pre-polymer 902 and the curative 904 to ultimately provide an opaque molded homogeneous polishing body. In a specific embodiment, the opacifying lubricant is a material such as, but not limited to: boron nitride, cerium fluoride, graphite, graphite fluoride, molybdenum sulfide, niobium sulfide, talc, tantalum sulfide, tungsten disulfide, or Teflon.

In an embodiment, the polishing pad precursor mixture 906 is used to ultimately form a molded homogeneous polishing body composed of a thermoset, closed cell polyurethane material. In one embodiment, the polishing pad precursor mixture 906 is used to ultimately form a hard pad and only a single type of curative is used. In another embodiment, the polishing pad precursor mixture 906 is used to ultimately form a soft pad and a combination of a primary and a secondary curative is used. For example, in a specific embodiment, the pre-polymer includes a polyurethane precursor, the primary curative includes an aromatic diamine compound, and the secondary curative includes an ether linkage. In a particular embodiment, the polyurethane precursor is an isocyanate, the primary curative is an aromatic diamine, and the secondary curative is a curative such as, but not limited to, polytetramethylene glycol, amino-functionalized glycol, or amino-functionalized polyoxypropylene. In an embodiment, pre-polymer, a primary curative, and a secondary curative have an approximate molar ratio of 100 parts pre-polymer, 85 parts primary curative, and 15 parts secondary curative. It is to be understood that variations of the ratio may be used to provide polishing pads with varying hardness values, or based on the specific nature of the pre-polymer and the first and second curatives.

Figure 9D:
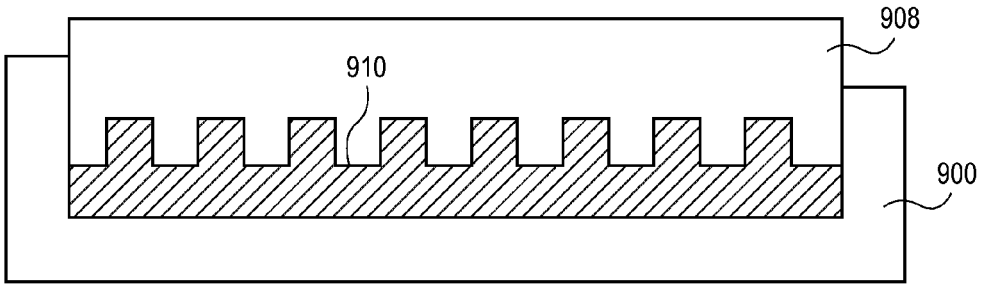

Referring to FIG. 9D, a lid 908 of the formation mold 900 is lowered into the mixture 906. In an embodiment, a plurality of grooves 910 is formed in the lid 908. The plurality of grooves is used to stamp a pattern of grooves into a polishing surface of a polishing pad formed in formation mold 900. It is to be understood that embodiments described herein that describe lowering the lid of a formation mold need only achieve a bringing together of the lid and a base of the formation mold. That is in some embodiments, a base of a formation mold is raised toward a lid of a formation mold, while in other embodiments a lid of a formation mold is lowered toward a base of the formation mold at the same time as the base is raised toward the lid.

Figure 9E:
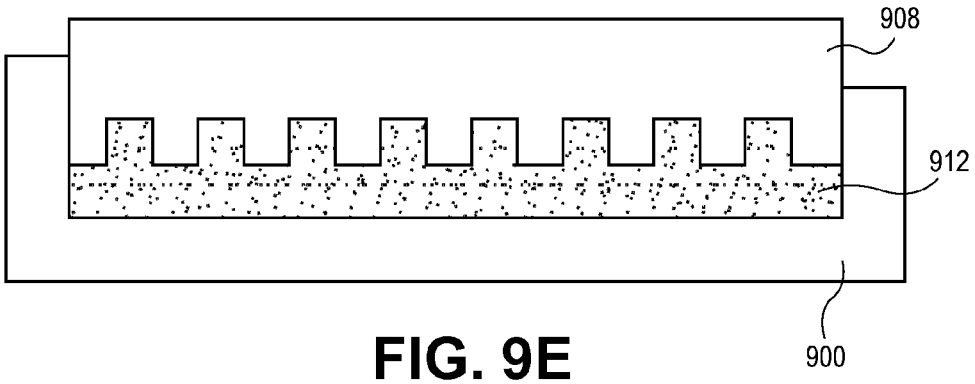

Referring to FIG. 9E, the mixture 900 is cured to provide a molded homogeneous polishing body 912 in the formation mold 900. The mixture 900 is heated under pressure (e.g., with the lid 908 in place) to provide the molded homogeneous polishing body 912. In an embodiment, heating in the formation mold 900 includes at least partially curing in the presence of lid 908, which encloses mixture 906 in formation mold 900, at a temperature approximately in the range of 200-260 degrees Fahrenheit and a pressure approximately in the range of 2-12 pounds per square inch.

Figure 9F:
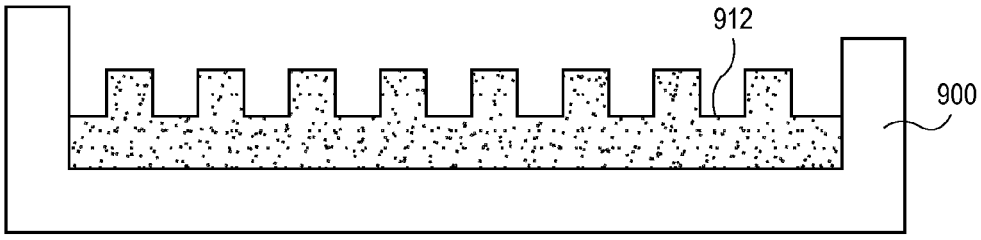
Figure 9G:
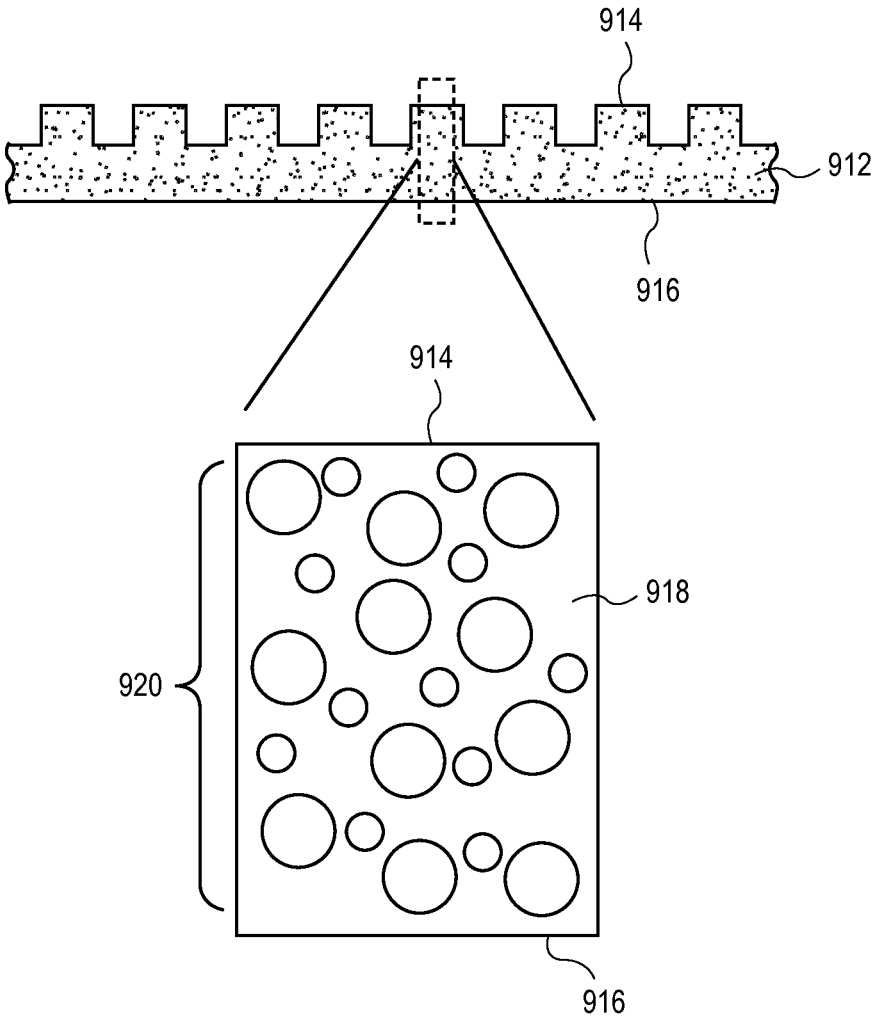

Referring to FIGS. 9F and 9G, a polishing pad (or polishing pad precursor, if further curing is required) is separated from lid 908 and removed from formation mold 900 to provide the discrete molded homogeneous polishing body 912. It is noted that further curing through heating may be desirable and may be performed by placing the polishing pad in an oven and heating. Thus, in one embodiment, curing the mixture 906 includes first partially curing in the formation mold 900 and then further curing in an oven. Either way, a polishing pad is ultimately provided, wherein a molded homogeneous polishing body 912 of the polishing pad has a polishing surface 914 and a back surface 916. The molded homogeneous polishing body 912 is composed of a thermoset polyurethane material 918 and a plurality of closed cell pores 920 disposed in the thermoset polyurethane material 918. The plurality of closed cell pores 920 has a multi-modal distribution of diameters, as described above, e.g., with respect to FIGS. 2A, 3A, 4A, 5A and 7A.

In an embodiment, referring again to FIG. 9B, the mixing further includes adding a plurality of porogens 922 to the pre-polymer 902 and the curative 904 to provide the closed cell pores 920. Thus, in one embodiment, each closed cell pore has a physical shell. In another embodiment, referring again to FIG. 9B, the mixing further includes injecting a gas 924 into to the pre-polymer 902 and the curative 904, or into a product formed there from, to provide the closed cell pores 920. Thus, in one embodiment, each closed cell pore has no physical shell. In a combination embodiment, the mixing further includes adding a plurality of porogens 922 to the pre-polymer 902 and the curative 904 to provide a first portion of the closed cell pores 920 each having a physical shell, and further injecting a gas 924 into the pre-polymer 902 and the curative 904, or into a product formed there from, to provide a second portion of the closed cell pores 920 each having no physical shell. In yet another embodiment, the pre-polymer 902 is an isocyanate and the mixing further includes adding water ($H_2O$) to the pre-polymer 902 and the curative 904 to provide the closed cell pores 920 each having no physical shell.

In an embodiment, curing the mixture 906 includes distributing the multi-modal distribution of diameters of closed cell pores 920 essentially evenly throughout the thermoset polyurethane material 918. However, in an alternative embodiment, the molded homogeneous polishing body 918 further includes a first, grooved surface and a second, flat surface opposite the first surface, and curing the mixture 900 includes grading the multi-modal distribution of diameters of closed cell pores 920 throughout the thermoset polyurethane material with a gradient from the first, grooved surface to the second, flat surface. In one such embodiment, the graded multi-modal distribution of diameters is a bimodal distribution of diameters including a small diameter mode proximate to the first, grooved surface, and a large diameter mode proximate to the second, flat surface.

Polishing pads described herein may be suitable for use with a variety of chemical mechanical polishing apparatuses. As an example, FIG. 10 illustrates an isometric side-on view of a polishing apparatus compatible with a polishing pad with a multi-modal distribution of pore diameters, in accordance with an embodiment of the present invention.

Figure 10:
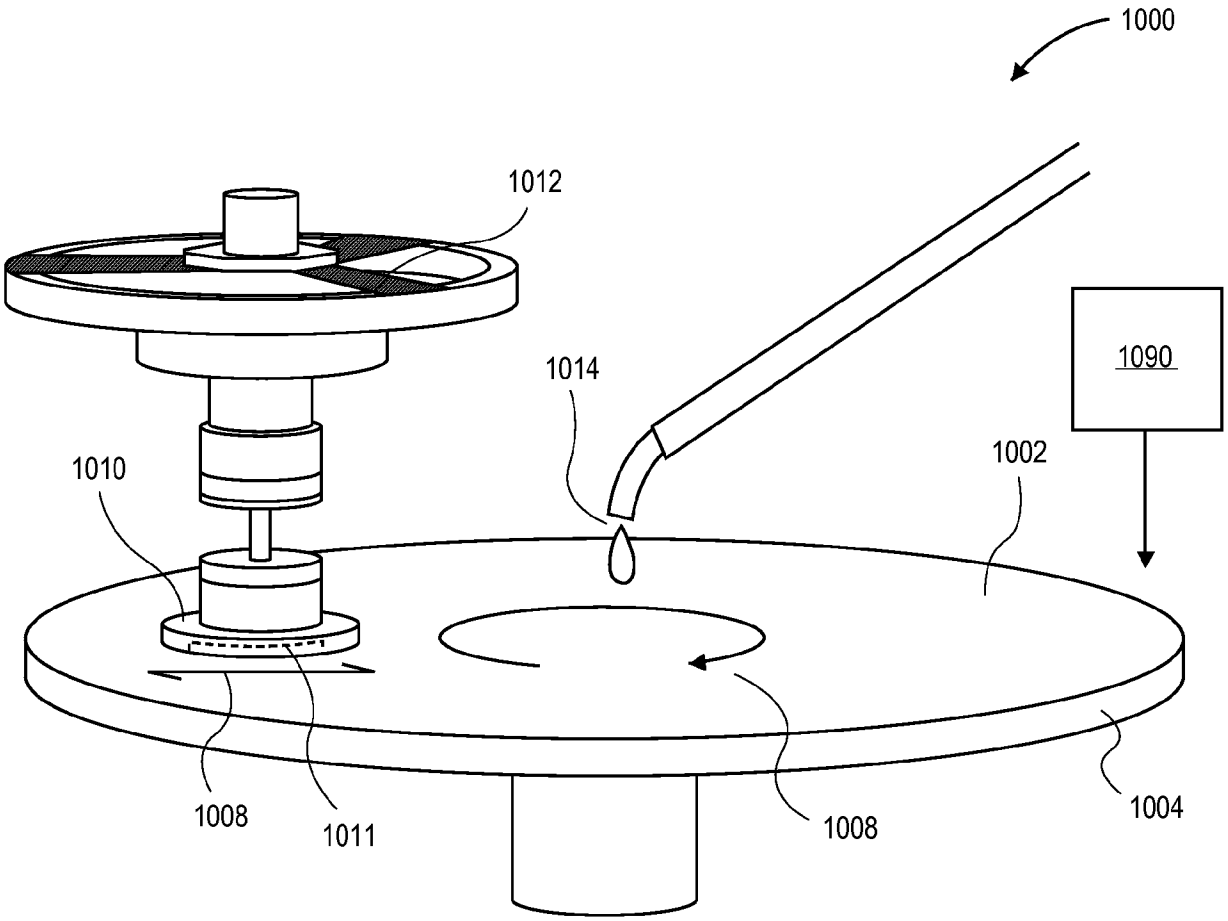
FIG. 10 illustrates an isometric side-on view of a polishing apparatus compatible with a polishing pad with a multi-modal distribution of pore diameters, in accordance with an embodiment of the present invention.

Referring to FIG. 10, a polishing apparatus 1000 includes a platen 1004. The top surface 1002 of platen 1004 may be used to support a polishing pad with a multi-modal distribution of pore diameters. Platen 1004 may be configured to provide spindle rotation 1006 and slider oscillation 1008. A sample carrier 1010 is used to hold, e.g., a semiconductor wafer 1011 in place during polishing of the semiconductor wafer with a polishing pad. Sample carrier 1010 is further supported by a suspension mechanism 1012. A slurry feed 1014 is included for providing slurry to a surface of a polishing pad prior to and during polishing of the semiconductor wafer. A conditioning unit 1090 may also be included and, in one embodiment, includes a diamond tip for condition the polishing pad, as described in association with FIGS. 6B and 8B.

Thus, polishing pads with multi-modal distributions of pore diameters have been disclosed. In accordance with an embodiment of the present invention, a polishing pad for polishing a semiconductor substrate includes a homogeneous polishing body. The homogeneous polishing body includes a thermoset polyurethane material. The homogeneous polishing body also includes a plurality of closed cell pores disposed in the thermoset polyurethane material and having a multi-modal distribution of diameters. In one embodiment, each of the closed cell pores is composed of a physical shell. In one embodiment, the multi-modal distribution of diameters is a bimodal distribution of diameters having a first, small diameter mode and a second, large diameter mode. In one embodiment, the homogeneous polishing body is a molded homogeneous polishing body.

What is claimed is:

1. A method of fabricating a polishing pad for polishing a semiconductor substrate, the method comprising:

mixing a pre-polymer and a curative to form a mixture in a formation mold; and curing the mixture to provide a molded homogeneous polishing body comprising a thermoset polyurethane material and a plurality of closed cell pores disposed in the thermoset polyurethane material, the plurality of closed cell pores having a multi-modal distribution of diameters, wherein the molded homogeneous polishing body further comprises a first, grooved surface and a second, flat surface opposite the first surface, and wherein curing the mixture comprises grading the multi-modal distribution of diameters throughout the thermoset polyurethane material with a gradient from the first, grooved surface to the second, flat surface, wherein the mixing further comprises adding a plurality of porogens to the pre-polymer and the curative to provide a first portion of the closed cell pores, each having a physical shell, and wherein the mixing further comprises injecting a gas into the pre-polymer and the curative, or into a product formed there from, to provide a second portion of the closed cell pores, each having no physical shell.

2. The method of claim 1, wherein the pre-polymer is an isocyanate.

3. The method of claim 1, wherein the multi-modal distribution of diameters is a bimodal distribution of diameters comprising a small diameter mode proximate to the first, grooved surface, and comprising a large diameter mode proximate to the second, flat surface.

4. The method of claim 1, wherein mixing the pre-polymer and the curative comprises mixing an isocyanate and an aromatic diamine compound, respectively.

5. The method of claim 1, wherein the mixing further comprises adding an opacifying lubricant to the pre-polymer and the curative to provide an opaque molded homogeneous polishing body.

6. The method of claim 1, wherein curing the mixture comprises first partially curing in the formation mold and then further curing in an oven.

7. A method of fabricating a polishing pad for polishing a semiconductor substrate, the method comprising:

mixing a pre-polymer and a curative to form a mixture in a formation mold; and curing the mixture to provide a molded homogeneous polishing body comprising a thermoset polyurethane material and a plurality of closed cell pores disposed in the thermoset polyurethane material, the plurality of closed cell pores having a multi-modal distribution of diameters, wherein the molded homogeneous polishing body further comprises a first, grooved surface and a second, flat surface opposite the first surface, and wherein curing the mixture comprises grading the multi-modal distribution of diameters throughout the thermoset polyurethane material with a gradient from the first, grooved surface to the second, flat surface, wherein the multi-modal distribution of diameters is a bimodal distribution of diameters comprising a small diameter mode proximate to the first, grooved surface, and comprising a large diameter mode proximate to the second, flat surface.

8. The method of claim 7, wherein the mixing further comprises adding a plurality of porogens to the pre-polymer and the curative to provide the closed cell pores, each having a physical shell.

9. The method of claim 7, wherein the mixing further comprises injecting a gas into the pre-polymer and the curative, or into a product formed there from, to provide the closed cell pores, each having no physical shell.

10. The method of claim 7, wherein the pre-polymer is an isocyanate and the mixing further comprises adding water to the pre-polymer and the curative to provide the closed cell pores, each having no physical shell.

11. The method of claim 7, wherein mixing the pre-polymer and the curative comprises mixing an isocyanate and an aromatic diamine compound, respectively.

12. The method of claim 7, wherein the mixing further comprises adding an opacifying lubricant to the pre-polymer and the curative to provide an opaque molded homogeneous polishing body.

13. The method of claim 7, wherein curing the mixture comprises first partially curing in the formation mold and then further curing in an oven.

* * * * *